US011353268B2

(12) United States Patent
Choi et al.

(10) Patent No.: US 11,353,268 B2
(45) Date of Patent: Jun. 7, 2022

(54) PLATE TYPE HEAT EXCHANGER

(71) Applicant: LG ELECTRONICS INC., Seoul (KR)

(72) Inventors: Jiwon Choi, Seoul (KR); Eungyul Lee, Seoul (KR); Hanchoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 14 days.

(21) Appl. No.: 16/927,028

(22) Filed: Jul. 13, 2020

(65) Prior Publication Data

US 2021/0033349 A1 Feb. 4, 2021

(30) Foreign Application Priority Data

Jul. 29, 2019 (KR) ..... 10-2019-0091522

(51) Int. Cl.
*F28D 9/00* (2006.01)
*F28F 3/04* (2006.01)

(52) U.S. Cl.
CPC ..... *F28D 9/0043* (2013.01); *F28F 3/046* (2013.01); *F28F 2275/122* (2013.01)

(58) Field of Classification Search
CPC ... F28D 9/0043; F28F 3/046; F28F 2275/122; F28F 9/0248; F28F 9/12
See application file for complete search history.

(56) References Cited

U.S. PATENT DOCUMENTS

| | | | | |
|---|---|---|---|---|
| 4,872,578 | A * | 10/1989 | Fuerschbach | F28D 9/005 165/167 |
| 6,708,730 | B2 * | 3/2004 | Chikuma | B23K 33/00 138/155 |
| 6,988,541 | B2 | 1/2006 | Nakajima et al. | |
| 7,568,520 | B2 * | 8/2009 | Ozawa | F28D 9/0043 138/89 |
| 9,951,998 | B2 * | 4/2018 | Bardeleben | F28F 9/0253 |
| 2019/0264984 | A1 * | 8/2019 | Takagi | F28F 9/0248 |

FOREIGN PATENT DOCUMENTS

| | | |
|---|---|---|
| EP | 2 551 626 | 1/2013 |
| JP | 11-051591 | 2/1999 |
| KR | 10-2010-0074435 | 7/2010 |
| KR | 10-2010-0133402 | 12/2010 |

* cited by examiner

*Primary Examiner* — Devon Russell
(74) *Attorney, Agent, or Firm* — Ked & Associates LLP

(57) ABSTRACT

A plate type heat exchanger includes a plate package in which a plurality of heat exchange plates is stacked to form a flow path, through which fluid flows, an end plate coupled to an outside of the plate package, and a socket connected to the plate package by passing through the end plate. The end plate includes a base which is in contact with the outside of the plate package, a socket hole which is formed through the base and into which the socket is inserted, and a ridge that protrudes outward from an edge of the socket hole of the base.

20 Claims, 8 Drawing Sheets

PLATE TYPE HEAT EXCHANGER

CROSS-REFERENCE TO RELATED APPLICATIONS

The present application claims priority under 35 U.S.C. 119 and 35 U.S.C. 365 to Korean Patent Application No. 10-2019-0091522 (filed on Jul. 29, 2019), which is hereby incorporated by reference in its entirety.

BACKGROUND

The present disclosure relates to a plate type heat exchanger.

A heat exchanger is an apparatus for guiding heat exchange between at least two fluids and may include a plate type heat exchanger, for example. The plate type heat exchanger includes at least two flow paths, through which fluids having different temperatures flow. The at least two flow paths may be alternately arranged.

The plate type heat exchanger has higher heat exchange efficiency than the other heat exchanger and the size and weight thereof may be reduced in the structure thereof.

As the prior art, Korean Patent Publication No. 10-2010-0133402 (Publication Date: Dec. 21, 2010) discloses a plate type heat exchanger.

The plate-type heat exchanger disclosed in the prior art includes a plurality of heat exchange plates, a first end plate, and a second end plate. The plurality of heat exchange plates, the first end plate, and the second end plate are permanently coupled to each other by a brazing material. In addition, each of the heat exchange plates includes a plurality of port hole regions surrounding each port hole and heat transfer regions.

Further, the plate type heat exchanger includes a plurality of flat elements coupled to the plate package and having a bottom surface facing the plate package. At least one of the plurality of flat elements extends from the bottom surface and is coupled by being in airtight contact with one of the port hole regions of at least one of the outermost heat exchanger plates.

However, the plate type heat exchanger disclosed in the prior art has the following problems.

First, since the conventional plate type heat exchanger is made by a method of brazing and fixing a plurality of heat exchange plates, first end plates, and second end plates, there is a problem in that the work process is complicated and mass production is difficult.

Second, a brazing failure may occur in a process of brazing a plurality of plates, and in this case, there is a problem in that a leak occurs in the heat exchanger and the force withstanding the inside pressure (referred to as internal pressure) is weakened. If the internal pressure is lowered, not only the heat exchange efficiency is lowered, but also a big problem in product reliability can cause.

SUMMARY

The present disclosure has been proposed to improve the above problems, and an object of the present disclosure is to provide a plate type heat exchanger that can reduce the number of parts and the work process compared to the existing plate type heat exchanger by changing the end plate shape.

Another object of the present disclosure is to provide a plate type heat exchanger that can shorten the assembly time and reduce the risk of leakage between parts by sealing the socket inside the end plate.

Another object of the present disclosure is to provide a plate type heat exchanger that can increase the internal pressure of the heat exchanger by optimizing the coupling shape of the end plate and the socket.

A plate type heat exchanger according to an embodiment of the present disclosure for achieving the above object includes a plate package in which a plurality of heat exchange plates is stacked to form a flow path, through which fluid flows, an end plate coupled to an outside of the plate package, and a socket connected to the plate package by passing through the end plate.

The end plate includes a base which is in contact with the outside of the plate package, a socket hole which is formed through the base and into which the socket is inserted, and a ridge which protrudes outward from an edge of the socket hole of the base.

At this time, a part of the socket may be in contact with an outer surface of the ridge, and the other part of the socket may be in contact with an inner surface of the ridge.

For example, the base may include a depression space provided by the ridge therein, and a part of the socket may be located in the depression space. At this time, the part of the socket may extend through the socket hole to the depression space of the ridge and may be in contact with an inner surface of the depression space of the ridge. The socket is fixed in a sealing manner inside the ridge.

Therefore, there is no need to weld the socket to the end plate, and the socket can be fixed in a simple way by sealing, thereby reducing the work process and significantly shortening the assembly time.

In addition, the socket may include a socket body formed in a pipe shape, a socket flange which extends from an end portion of the socket body to have a larger diameter and is in contact with the ridge, and a sealing portion which extends from the end portion of the socket flange to have a smaller diameter and is inserted into the socket hole.

The sealing portion may be bent outward in a radial direction of the socket and extend into the depression space. At this time, the sealing portion may be bent in a direction perpendicular to the central axis of the socket to be in close contact with the inner surface of the ridge.

In a state where the sealing portion is in close contact with the inner surface of the ridge, the end portion of the sealing portion and the inner surface of the base may be located on the same plane perpendicular to the central axis of the socket. For example, the depression depth of the depression space may be formed to be the same as the thickness of the sealing portion. In addition, a heat exchange plate that is disposed on the outermost side of the plurality of heat exchange plates and the sealing portion may be in contact with each other.

Therefore, since the heat exchange plate having a curved shape can be directly connected to the inner surface of the end plate, there is an advantage that the assembly degree of freedom is large.

The plurality of heat exchange plates may include a first plate formed at a position corresponding to the socket and having a first port communicating with the socket hole, and a second plate formed at a position corresponding to the socket and having a second port communicating with the first port.

A first flow path through which the first fluid flows and a second flow path through which the second fluid flows may be formed inside the plate package, and either the first fluid or the second fluid may flow inside the socket.

The socket may include at least one of a first inlet allowing the first fluid to flow into the plate package, a first outlet allowing the first fluid to be discharged from the plate package, a second inlet allowing the second fluid to flow into the plate package, and a second outlet allowing the second fluid to be discharged from the plate package.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
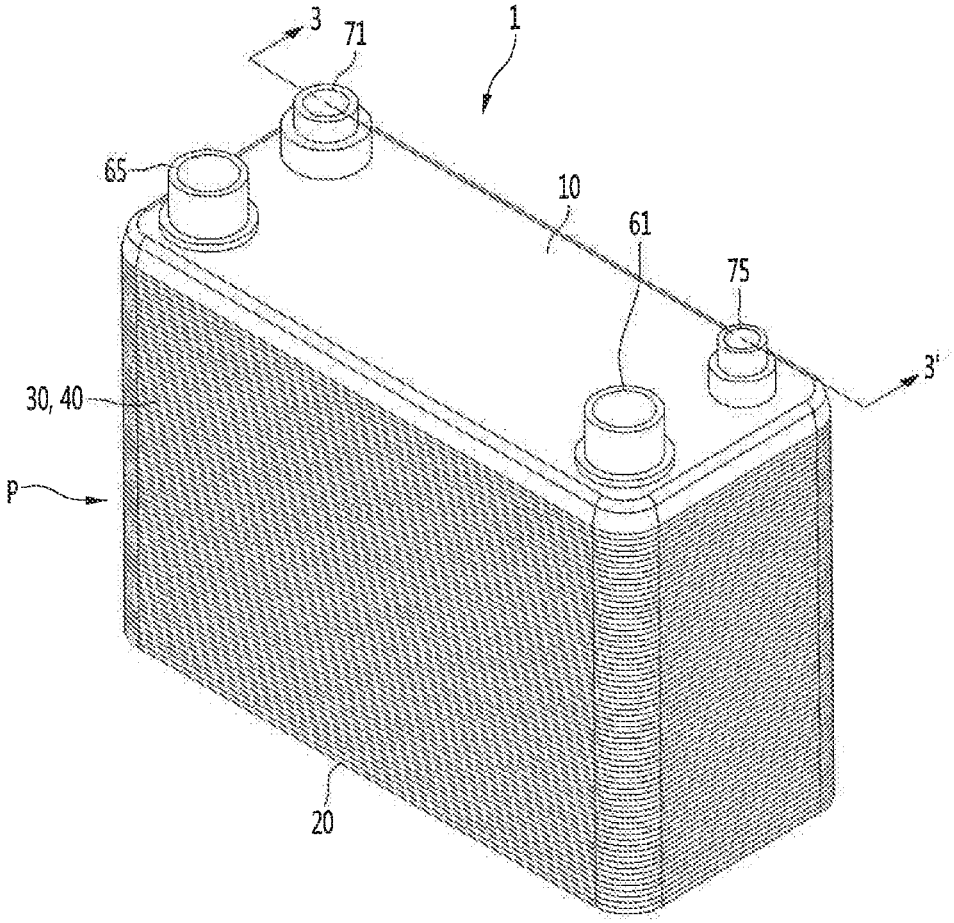
FIG. 1 is a perspective view of a plate type heat exchanger according to an embodiment of the present disclosure.
Figure 2:
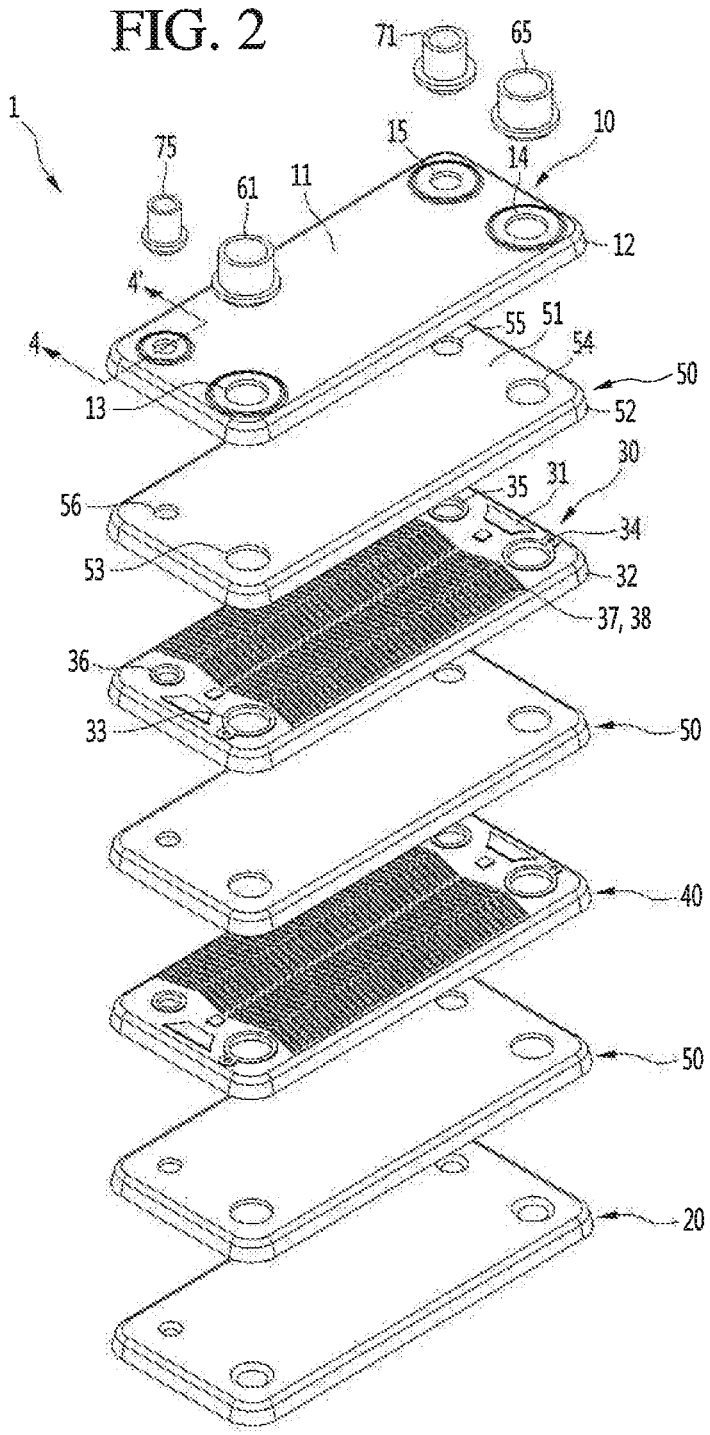
FIG. 2 is an exploded perspective view of a plate type heat exchanger according to an embodiment of the present disclosure.
Figure 3:
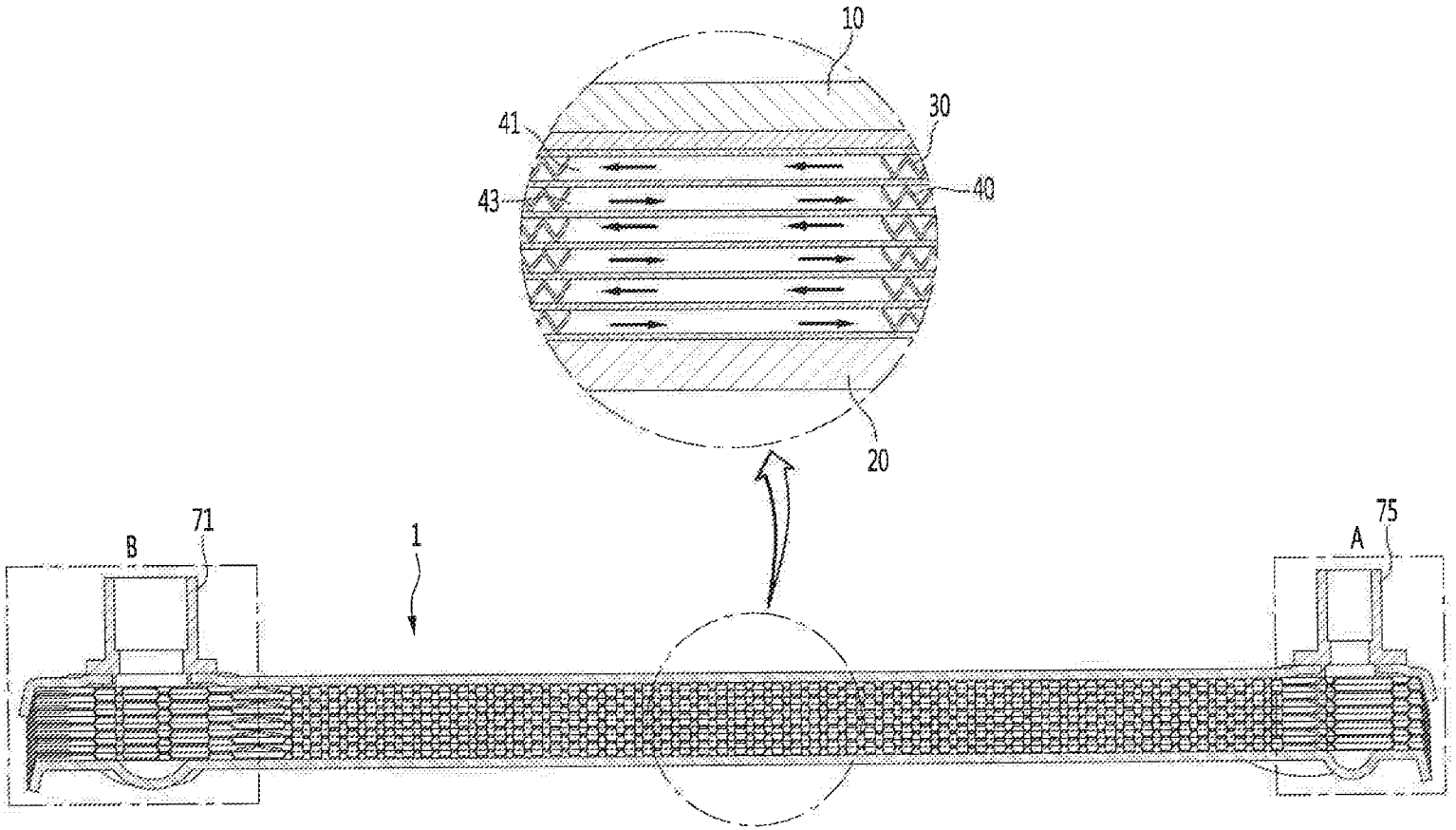
FIG. 3 is a cross-sectional view taken along line 3-3' of FIG. 1.

FIG. 1 is a perspective view of a plate type heat exchanger according to an embodiment of the present disclosure, FIG. 2 is an exploded perspective view of a plate type heat exchanger according to an embodiment of the present disclosure, and FIG. 3 is a cross-sectional view taken along line 3-3' of FIG. 1.

Referring to FIGS. 1 to 3, the plate type heat exchanger 1 according to the embodiment of the present disclosure includes a plate package P including a plurality of heat exchange plates 30 and 40 and two end plates 10 and 20 provided at both ends of the plate package P. For example, the heat exchange plates 30 and 40 and the two end plates 10 and 20 may have a quadrangular panel shape.

The heat exchange plates 30 and 40 may be composed of a metal material having excellent thermal conductivity and excellent pressure resistance. For example, the heat exchange plates 30 and 40 may be composed of a stainless material.

The heat exchange plates 30 and 40 includes a plurality of first plates 30 and a plurality of second plates 40. The first plates 30 and the second plates 40 may be alternately stacked one by one in a vertical direction based on FIG. 1.

The vertical direction may be referred to as a "stacking direction".

Flow paths 41 and 43, through which fluid flows, are formed between the plurality of heat exchange plates 30 and 40. The flow paths 41 and 43 include a first flow path 41, through which first fluid flows, and a second flow path 43, through which second fluid flows. The first and second flow paths 41 and 43 may be alternately arranged in turn. That is, the first and second flow paths 41 and 43 may be alternately formed in the stacking direction, such that the first fluid and the second fluid independently flow without being combined.

Refrigerant may flow in the first flow path 41. The first flow path 41 is a flow path, through which refrigerant flows, and thus may be referred to as a "refrigerant flow path". Water may flow in the second flow path 43. The second flow path 43 is a flow path, through which water flows, and thus may be referred to as a "water flow path".

The two end plates 10 and 20 include a first end plate 10 provided above the plate package P and a second end plate 20 provided below the plate package P. That is, the plate package P may be disposed between the two end plates 10 and 20.

The plate type heat exchanger 1 further includes sockets 61, 65, 71 and 75 for providing the first fluid and the second fluid into the plate package P or discharging the first fluid and the second fluid from the plate package P to the outside.

The sockets 61, 65, 71 and 75 may include at least one of a first inlet 61, a second inlet 71, a first outlet 65 or a second outlet 75.

Specifically, the plate type heat exchanger 1 further includes the first inlet 61, through which the first fluid flows into the plate package P, and the second inlet 71, through which the second fluid flows into the plate package P.

The first inlet 61 and the second inlet 71 may be coupled to the first end plate 10. The first and second fluids have a temperature difference and may exchange heat with each other. For example, the first fluid may be refrigerant and the second fluid may be water. Accordingly, the first inlet 61 may be referred to as a "refrigerant inlet" and the second inlet 71 may be referred to as a "water inlet".

The plate type heat exchanger 1 further includes a first outlet 65, through which the first fluid is discharged from the plate package P, and a second outlet 75, through which the second fluid is discharged from the plate package P. The first outlet 65 and the second outlet 75 may be coupled to the first end plate 10.

For example, the first inlet 61 and the second inlet 71 may be disposed at corners located in a diagonal direction among the four corners of the first end plate 10. The first outlet 65 and the second outlet 75 may be disposed at corners located in another diagonal direction among the four corners of the first end plate 10. That is, the first inlet 61 and the second outlet 75 may be adjacently disposed, and the second inlet 71 and the second outlet 65 may be adjacently disposed.

Alternatively, the first inlet 61 and the first outlet 65 may be disposed at corners located in a diagonal direction among the four corners of the first end plate 10, and the second inlet 71 and the second outlet 75 may be disposed at corners located in another diagonal direction among the four corners of the first end plate 10.

The heat exchange plates 30 and 40 include the plurality of first plates 30 and the plurality of second plates 40. the first plates 30 and the second plates 40 may have the same shape. Alternatively, the first plates 30 and the second plates 40 may have a symmetrical shape.

In the present embodiment, the first plate 30 includes a plate body 31 having a substantially quadrangular panel shape and an edge portion 32 surrounding the outside of the plate body 31.

In addition, the first plate 30 further includes a plurality of input/output ports 33, 34, 35 and 36 disposed at four corners of the plate body 31 to communicate with the first and second inlets 61 and 71 and the first and second outlets 65 and 75 to guide flow of the fluid. The plurality of input/output ports 33, 34, 35 and 36 may penetrate through at least a portion of the plate body 31.

The plurality of input/output ports 33, 34, 35 and 36 includes a first input port 33 formed at a position corresponding to the first inlet 61 such that the first fluid (refrigerant) is introduced therethrough, and a first output port 34 formed at a position corresponding to the first outlet 65 such that the first fluid is discharged therethrough. The first input port 33 may be referred to as a "refrigerant input port" and the first output port 34 may be referred to as a "refrigerant output port".

The refrigerant may flow into the first flow path 41 of the plate package P while flowing the lower side of the first plates 30 through the first input port 33, and the refrigerant heat-exchanged in the first flow path 41 may be discharged from the plate package P through the first output port 34 to flow upward toward the first outlet 65.

The plurality of input/output ports 33, 34, 35 and 36 includes a second input port 35 formed at a position corresponding to the second inlet 71 such that the second fluid (water) is introduced therethrough and a second output port 36 formed at a position corresponding to the second outlet 75 such that the second fluid is discharged therethrough. The second input port 35 may be referred to as a "water input port", and the second output port 36 may be referred to as a "water output port".

Water may flow into the first flow path 43 of the plate package P while flowing to the lower side of the first plates 30 through the second input port 35, and the water heat-exchanged in the first flow path 43 may be discharged from the plate package P through the second output port 36 to flow upward toward the second outlet 75.

The plurality of input/output ports 33, 34, 35 and 36 is formed in the first plates 30 and may be referred to as a "first port".

In addition, the plurality of input/output ports may be formed even in the second plates 40. Accordingly, the plurality of input/output ports formed in the second plates 40 may be referred to as a "second port".

The upper surface of the plate body 31 includes irregularities. Specifically, the irregularities include protrusions 37 protruding upward from the upper surface of the plate body 31 and depressions 38 recessed downward from the upper surface of the plate body 31. A plurality of protrusions 37 and depressions 38 may be provided and may be alternately arranged. In addition, irregularities may be included in the lower surface of the plate body 31.

For example, by the plurality of protrusions 37 and the plurality of depressions 38, a herringbone pattern may be formed in the upper and lower surfaces of the plate body 31.

The irregularities of the plate body 31 may be provided to be in contact with irregularities provided in another adjacent heat exchange plate 40. In addition, the contacted irregularities may be adhered by a predetermined method. The predetermined method may include welding or adhesion using an adhesive. For example, the protrusions of the second plates 40 may adhere to the depressions 38 of the first plates 30.

The plate package P includes a plurality of heat exchange plates 30 and 40. For example, the plate package P may include 76 heat exchange plates. Of these, ½, that is, 38 heat exchange plates may be plates contributing to forming the first flow path 41, and the remaining 38 heat exchange plates may be plates contributing to forming the second flow path 41.

The adjacent plates forming the first and second flow paths 41 and 43 may be alternately arranged. For example, the first and second plate are adhered to form the first flow path 41 and the second and third plates are adhered to form the second flow path 43. In addition, the third and fourth plates may be adhered to form the first flow path 41. This arrangement may be repeated to configure the plate package P.

The plate type heat exchanger 1 further includes a plurality of copper plates 50 for brazing the plurality of plates 10, 20, 30 and 40 configuring the plate type heat exchanger 1.

Specifically, the copper plates 50 may be inserted between the first and second end plate 10 and 20, respectively and then brazed. That is, the copper plates 50 may be used as filler metal for brazing.

In the present embodiment, the copper plate 50 may be disposed between the first end plate 10 and the first plate 30, the copper plate 50 may be disposed between the first plate 30 and the second plate 40, and the copper plate 50 may be disposed between the second plate 40 and the second end plate 20.

The copper plate 50 has a flat surface and may be brazed by sequentially stacking the heat exchange plates 30 and 40 in which the first and second flow paths 41 and 43 having a V shape (wrinkled shape) are formed. At this time, the copper plate 50 is filler metal and the copper plate 50 is melted at a high temperature by a capillary phenomenon between the stacked heat exchange plates 30 and 40 to be adhered to the heat exchange plates 30 and 40 by a cooling process.

The copper plate 50 includes a copper body 51 forming the flat surface and an edge portion 52 surrounding the outside of the copper body 51. The edge portion 52 extends downward from the edge of the copper body 51.

The copper body 51 includes a first hole 53 formed through a position corresponding to the first inlet 61, a second hole 54 formed through a position corresponding to the first outlet 65, a third hole 55 formed through a position corresponding to the second inlet 71, and a fourth hole 56 formed through a position corresponding to the second outlet 75.

The first end plate 10 is disposed above the plate package P and is a part which is coupled with the first and second inlets 61 and 71 and the first and second outlets 65 and 75.

The first end plate 10 includes a base 11 having a flat surface and an edge portion 12 extending from the edge of the base 11. The edge portion 12 may extend downward from the edge of the base 11.

The base 11 includes a first insertion hole 12, into which the first inlet 61 is inserted, a second insertion hole 14, into which the first outlet 65 is inserted, a third insertion hole 15, into which the second inlet 71 is inserted, and a fourth insertion hole 16, into which the second outlet 75 is inserted.

The first to fourth insertion holes 13, 14, 15, and 16 are holes, into which sockets are inserted, and thus may be referred to as "socket holes".

The first insertion hole 13 is aligned in the vertical direction (overlapping direction) with the first hole 53 of the copper plate 50 and the first input port 33 of the heat exchange plate 30, and the second insertion hole 14 is aligned in the vertical direction with the second hole 54 of the copper hole 50 and the first output port 34 of the heat exchange plate 30.

The third insertion hole 15 is aligned in the vertical direction with the third hole 55 of the copper plate 50 and the second input port 35 of the heat exchange plate 30, and the fourth insertion hole 16 is aligned in the vertical direction with the fourth hole 56 of the copper plate 50 and the second output port 36 of the heat exchange plate 30.

Accordingly, refrigerant flows into the plate package P through the first inlet 61 and flows along the first flow path 41, thereby being discharged through the first outlet 65. Water flows into the plate package P through the second inlet 71 and flows along the first flow path 43, thereby being discharged through the second outlet 75.

In this process, the refrigerant of the first flow path 41 may exchange heat with the water of the second flow path 43. Since the first flow path 41 and the second flow path 43 are alternately arranged in the stacking direction, the refrigerant and the water may independently flow without being mixed.

Figure 4:
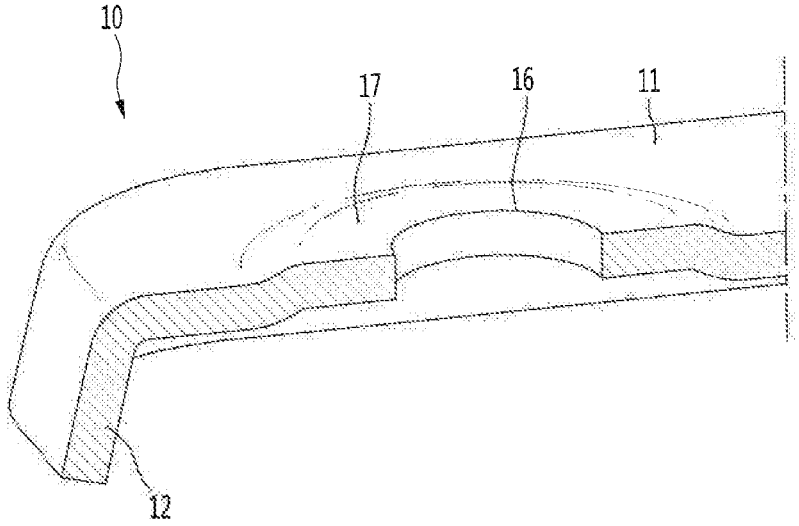
FIG. 4 is a cross-sectional perspective view taken along line 4-4' of FIG. 2.
Figure 5:
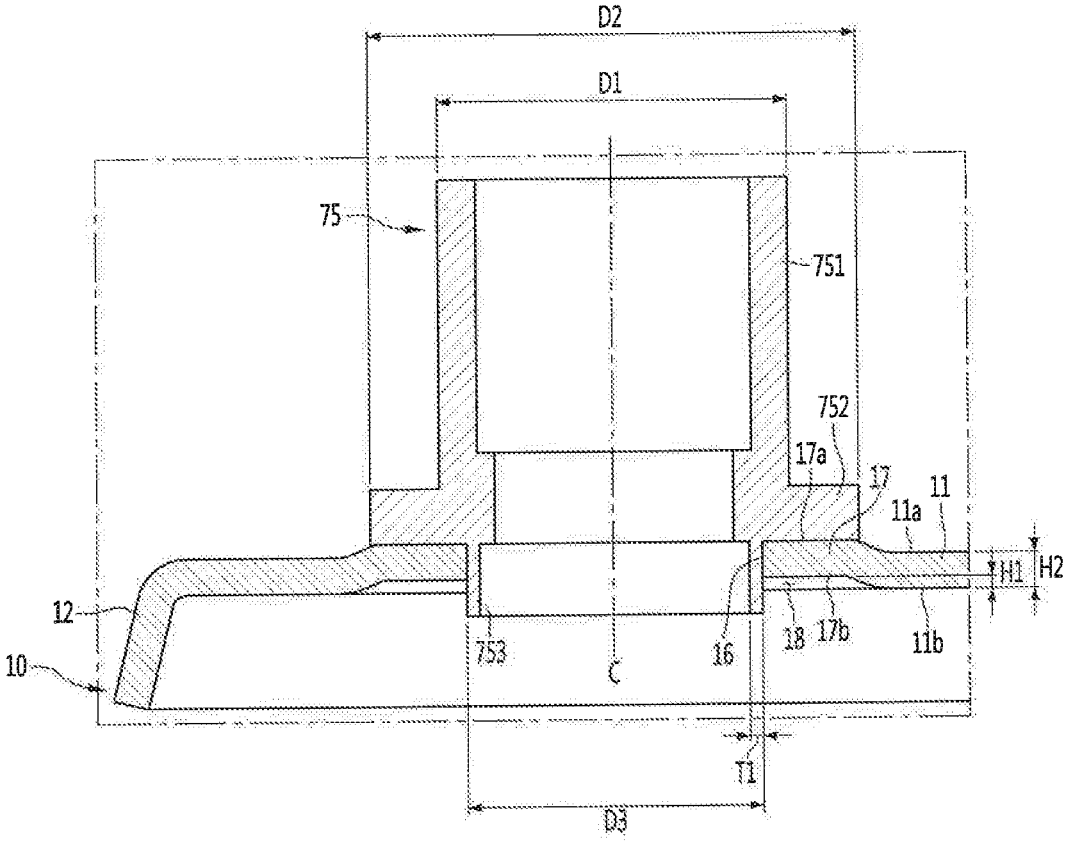
FIG. 5 is a cross-sectional view illustrating a state where a socket is inserted into the first end plate according to an embodiment of the present disclosure.
Figure 6:
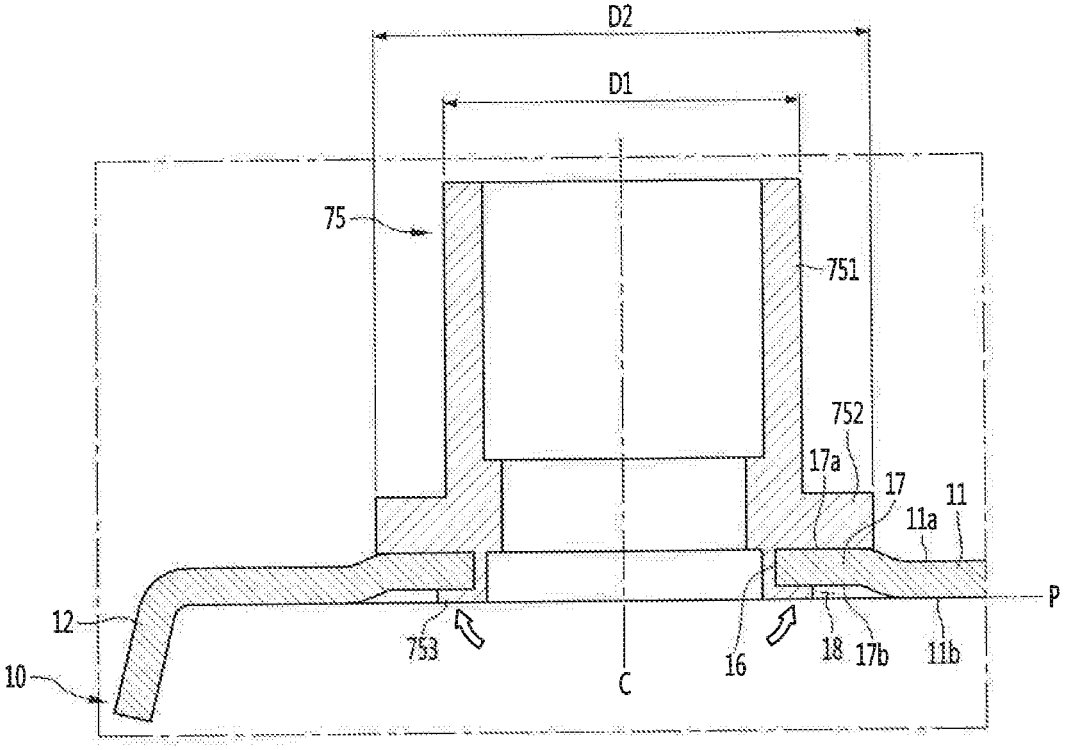
FIG. 6 is a cross-sectional view illustrating a state where the socket of FIG. 5 is sealed inside the first end plate.

FIG. 4 is a cross-sectional perspective view taken along line 4-4' of FIG. 2, FIG. 5 is a cross-sectional view illustrating a state where a socket is inserted into the first end plate according to an embodiment of the present disclosure, and FIG. 6 is a cross-sectional view illustrating a state where the socket of FIG. 5 is sealed inside the first end plate.

Referring to FIGS. 2 to 6 together, the sockets 61, 65, 71, and 75 according to the present embodiment may be inserted by sealing inside the first end plate 10. That is, the first inlet 61, the first outlet 65, the second inlet 71, and the second outlet 75 may be fixed to the first end plate 10 in a sealing manner.

However, in the present embodiment, for example, a method for sealing the second outlet 75 in the first end plate 10 will be described.

Specifically, the first end plate 10 includes a base 11 having a quadrangular panel shape and an edge portion 12 extending downward from the edge of the base 11.

The base 11 includes an outer surface 11*a* having a flat surface and an inner surface 11*b* having a flat surface. Here, it can be understood that the outer surface 11*a* is a surface corresponding to the upper surface of the base 11, and the inner surface 11*b* is a surface corresponding to the lower surface of the base 11. That is, the inner surface 11*b* may be understood as a surface facing the plate package P, and the outer surface 11*a* may be understood as a surface forming an outer appearance.

The first end plate 10 includes a ridge 17 protruding outward from the base 11.

The ridge 17 is a portion in which at least a portion of the base 11 protrudes outward (upward). In addition, the first and second inlets 61 and 71 or the first and second outlets 65 and 75 may be inserted into the ridge 17. That is, four ridges 17 are formed in the first end plate 10, and the first to fourth insertion holes 13, 14, 15, and 16 can be formed in ridges 17, respectively.

On the other hand, the base 11 of the first end plate 10 may be formed with a socket hole 16 into which the socket 75 is inserted and include a ridge 17 protruding outward from the edge of the socket hole 16.

As the ridge 17 protrudes outward of the first end plate 10, a depression space 18 may be formed inside (inner surface) the first end plate 10. That is, by the height difference H1 between the inner surface 11*b* of the base 11 and the inner surface 17*b* of the ridge 17, the depression space 18 may be formed in the inner surface 17*b* of the first end plate 10.

At this time, the ridge 17 may have a circular horizontal cross-section, and thus the depression space 18 may have a circular horizontal cross-section and may be formed to have a predetermined depression depth H1.

In the present embodiment, the depression depth H1 of the depression space 18 may be designed to be equal to or less than half of the thickness H2 of the base 11. The reason for this is that if the depression depth H1 of the depression space 18 is too large, the thickness of the sealing portion of the socket to be described later has to be relatively thick, and if the thickness of the sealing portion is thick, the flow rate in the socket may be reduced.

In addition, if the depression depth H1 of the depression space 18 is too small, the thickness of the sealing portion of the socket should be relatively thin, and if the thickness of the sealing portion is thin, the sealing portion may be torn or leakage may be generated during the sealing process.

Therefore, the depression depth H1 of the depression space 18 should be properly designed, and the depression depth H1 of the depression space 18 is preferably one-third of the thickness H2 of the base 11.

Meanwhile, the second outlet 75 includes a socket body 751, a socket flange 752 extending to increase in diameter at the end portion of the socket body 751, and a sealing portion 753 extending to be small in diameter at the end portion of the socket flange 752.

The socket body 751 is formed of a hollow pipe, and a water pipe (not illustrated) through which water flows may be inserted therein. The socket body 751 has a predetermined diameter D1 and may be formed to be larger than the diameter of the fourth insertion hole 16.

The socket flange 752 is formed to extend outward from the lower end portion of the socket body 751 in a radial direction. That is, the socket flange 752 has a diameter D2 larger than the diameter D1 of the socket body 751. If the second outlet 75 is inserted into the fourth insertion hole 16, the lower surface of the socket flange 752 is in contact with the outer surface 11*a* of the base 11.

The sealing portion 753 is a portion that is coupled inside the fourth insertion hole 16 in a sealing manner. The sealing portion 753 may extend downward from the lower end of the socket flange 752. The sealing portion 753 has a diameter D3 smaller than the diameter D1 of the socket body 751. The sealing portion 753 can be fixed by bending the end portion in an outward direction while being inserted into the fourth insertion hole 16.

Specifically, a portion of the sealing portion 753 corresponding to half in the vertical direction may be inserted into the fourth insertion hole 16. In addition, the sealing portion 753 corresponding to the other half can be warped or bent outward in the radial direction based on FIG. 6.

In the present embodiment, the sealing portion 753 is bent perpendicular to the central axis C of the socket. That is, the sealing portion 753 can be bent 90 degrees outward in the radial direction. Then, the bent portion of the sealing portion 753 extends or is disposed in the depression space 18.

That is, as the sealing portion 753 is expanded from the inside of the fourth insertion hole 16, the outer circumferential surface of the sealing portion 753 may be in full contact with the inner surface 17*b* of the ridge 17. Therefore, a part of the socket 75 is in close contact with the outer surface 17*a* of the ridge 17, and the other part thereof is in close contact with the inner surface 17*b* of the ridge 17.

According to this configuration, since the sealing portion 753 is inserted inside the first end plate 10, and at least a portion of the sealing portion 753 is in contact with the inner surface of the first end plate 10, there is an advantage in that leakage between the first end plate 10 and the second outlet 75 is significantly reduced. In addition, since the sealing portion 753 is bent at 90 degrees outward in the radial direction, the maximum area of the sealing portion 753 can be in contact with the first end plate 10, thereby improving the internal pressure of the heat exchanger.

In addition, in a state where the sealing portion 753 is located in the depression space 18, the bent portion of the sealing portion 753 may be in line with the inner surface 11*b* of the base 11. That is, the bent portion of the sealing portion 753 and the inner surface 11*b* of the base 11 may be located on the same plane P perpendicular to the central axis C of the socket 75.

According to this configuration, since the step between the inner surface 11*b* of the base 11 and the end portion of the sealing portion 753 disappears, the heat exchange plate 30 having a curved shape on the inner surface of the first end plate 10 can be directly connected. Therefore, there is an advantage that the assembly degree of freedom between the socket, the end plate, and the heat exchange plate is large.

In addition, in the prior art, a separate flat plate is used to couple the socket to the end plate, whereas in the present disclosure, the flat plate is unnecessary, so a mold for manufacturing the flat plate can be omitted.

Figure 7:
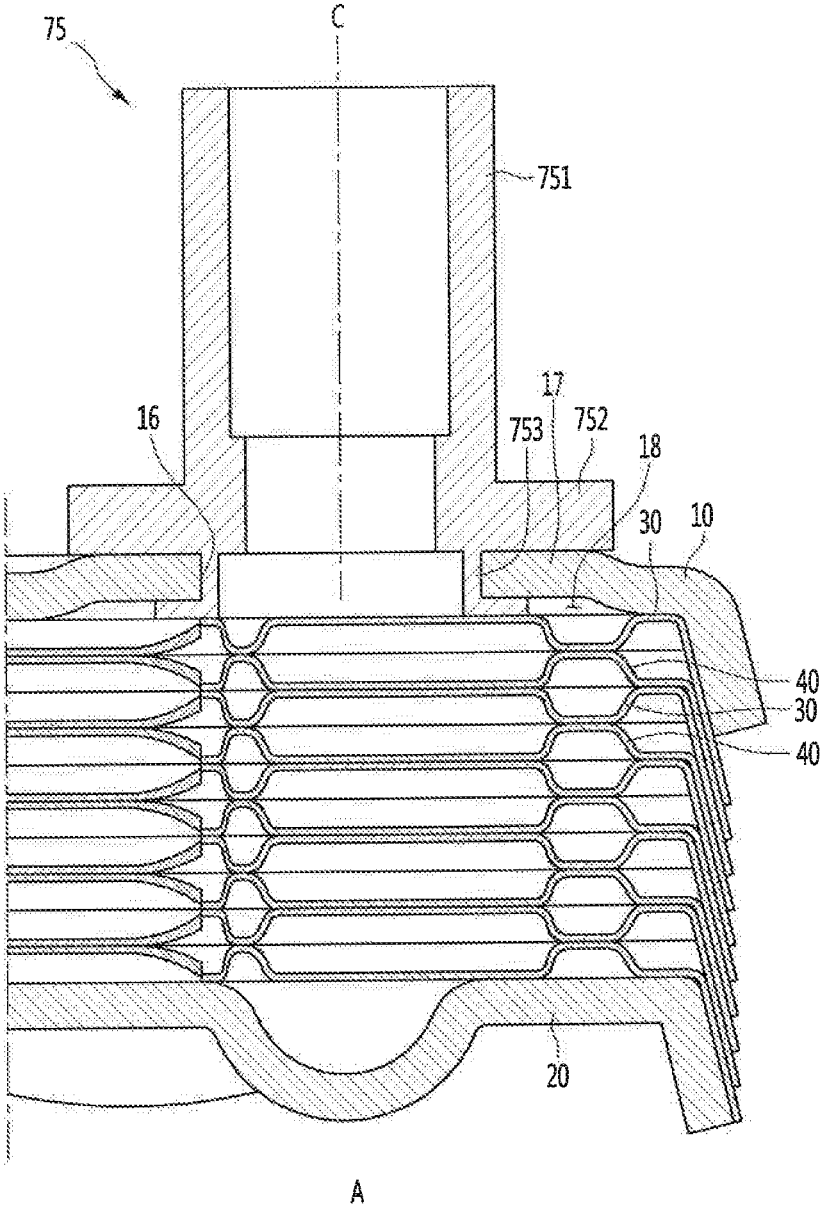
FIG. 7 is an enlarged view illustrating part "A" of FIG. 3.
Figure 8:
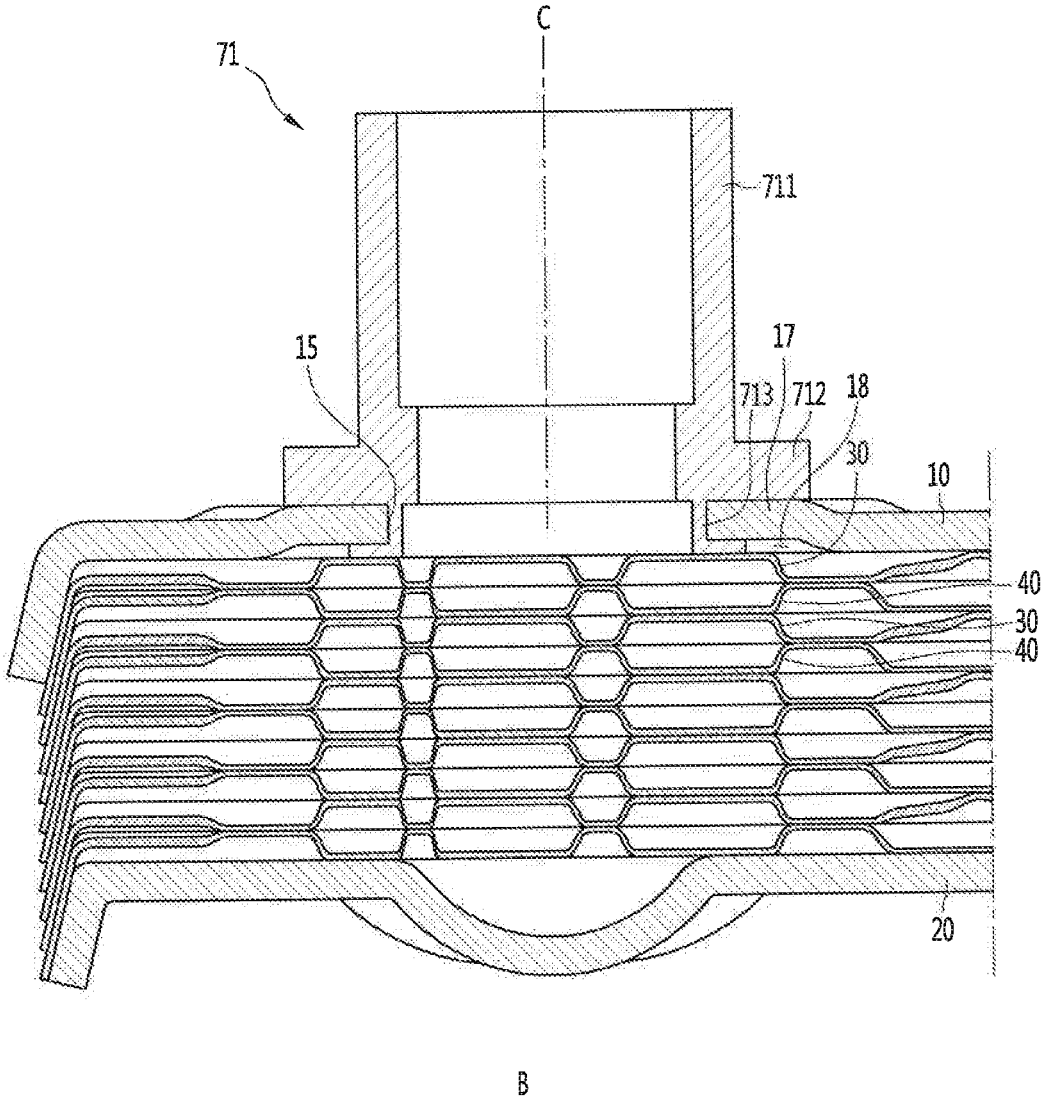
FIG. 8 is an enlarged view illustrating part "B" of FIG. 3.

FIG. 7 is an enlarged view illustrating part "A" of FIG. 3, and FIG. 8 is an enlarged view illustrating part "B" of FIG. 3.

First, referring to FIG. 7, as described above, a plurality of heat exchange plates 30 and 40 are alternately stacked one by one in the vertical direction to form a plate package P. In addition, the first end plate 10 is disposed on the upper portion of the plate package P, and the second end plate 20 is disposed on the lower portion of the plate package P.

The second outlet 75 is sealed after the sealing portion 753 is inserted into the fourth insertion hole 16 of the first end plate 10. At this time, the sealing portion 753 is bent at 90 degrees outward in the radial direction to be in close contact with the inner depression space 18 of the first end plate 10.

If the sealing portion 753 is in close contact with the inner surface of the first end plate 10, the end portion of the sealing portion 753 and the inner surface 11*b* of the base 11 may be located on the same plane without a step. Accordingly, the second outlet 75 is prevented from being interfered with the outermost heat exchange plate 30 of the plate package P in the process of the second outlet 75 being sealed.

That is, even if there are irregularities around the second outlet port 36 formed in the heat exchange plate 30, the assembly of the sealing portion 753 is not interfered due to the irregularities of the heat exchange plate 30, and thus there is an advantage that assembly degree of freedom between parts is large.

In addition, referring to FIG. 8, the second inlet 71 is sealed after the sealing portion 713 is inserted into the third insertion hole 15 of the first end plate 10. At this time, the sealing portion 713 is bent at 90 degrees outward in the radial direction to be in close contact with the inner depression space 18 of the first end plate 10.

If the sealing portion 713 is in close contact with the inner surface of the first end plate 10, the end portion of the sealing portion 713 and the inner surface 11*b* of the base 11 may be located on the same plane without a step. Accordingly, the first inlet 75 is prevented from being interfered with the outermost heat exchange plate 30 of the plate package P in the process of the second inlet 71 being sealed.

That is, even if there are irregularities around the second inlet port 35 formed in the heat exchange plate 30, the assembly of the sealing portion 713 is not interfered due to the irregularities of the heat exchange plate 30, and thus there is an advantage that assembly degree of freedom between parts is large.

The plate type heat exchanger according to the embodiment of the present disclosure constituting the above configuration has the following effects.

First, since the socket is fixed to the inside of the end plate by a sealing manner, there is an advantage that the working process is simplified and the assembly time is shortened.

Second, the end plate of the present disclosure includes a ridge that protrudes outwardly from the edge of the socket hole into which the socket is inserted, so that a portion of the socket inserted into the socket hole can be securely fixed inside the depression space provided by the ridge, and thus there is an advantage that airtightness can be maintained between the socket and the end plate.

Third, since the thickness T1 of the sealing portion of the socket is formed to be equal to the depression depth H1 of the depression space formed in the end plate, the end portion of the sealing portion and the inner surface of the end plate may be located on the same plane perpendicular to the central axis of the socket. Therefore, since the socket is prevented from being interfered by irregularities formed on the surface of the heat exchange plate during the process of the socket being sealed on the end plate, there is an advantage that assembly degree of freedom between parts is large.

Fourth, since the end plate is formed with a base formed with a plurality of socket holes into which a plurality of sockets are inserted and a ridge protruding outwardly from the edge of each socket hole, there is an advantage that the mass production is possible and it is applicable to various plate type heat exchangers.

What is claimed is:

1. A plate type heat exchanger, comprising:

a plate package in which a plurality of heat exchange plates is stacked to form a flow path, through which fluid flows;

an end plate coupled to an outside of the plate package; and a socket connected to the plate package by passing through the end plate, wherein the end plate includes:

a base which is in contact with the outside of the plate package;

a socket hole which is formed through the base and into which the socket is inserted; and a ridge that protrudes outward from an edge of the socket hole of the base, wherein the socket includes:

a socket body formed in a pipe shape;

a socket flange that extends from an end portion of the socket body in a radial direction of the socket body to have a diameter larger than a diameter of the socket body and is in contact with the ridge; and a sealing portion that extends from an end portion of the socket flange in an axial direction of the socket body to have a diameter smaller than the diameter of the socket body and is inserted into the socket hole, wherein the base includes a depression space between the ridge and the plate package, and wherein the sealing portion is bent outward in the radial direction and is disposed in the depression space.

2. The plate type heat exchanger of claim 1, wherein a portion of the sealing portion is in contact with an inner surface of the depression space of the ridge.

3. The plate type heat exchanger of claim 1, wherein the socket is fixed in a sealing manner inside of the ridge.

4. The plate type heat exchanger of claim 1, wherein the sealing portion is bent in a direction perpendicular to a central axis of the socket to be in close contact with an inner surface of the ridge.

5. The plate type heat exchanger of claim 4, wherein, in a state in which the sealing portion is in close contact with the inner surface of the ridge, the end portion of the sealing portion and the inner surface of the base are located on a same plane perpendicular to the central axis of the socket.

6. The plate type heat exchanger of claim 1, wherein a depression depth of the depression space is formed to be the same as a thickness of the sealing portion.

7. The plate type heat exchanger of claim 1, wherein a heat exchange plate of the plurality of heat exchange plates that is disposed at an outermost side of the plurality of heat exchange plates and the sealing portion are in contact with each other.

8. The plate type heat exchanger of claim 1, wherein the plurality of heat exchange plates includes:

a first plate formed at a position corresponding to the socket and having a first port communicating with the socket hole; and a second plate formed at a position corresponding to the socket and having a second port communicating with the first port.

9. The plate type heat exchanger of claim 1, wherein a first flow path through which a first fluid flows and a second flow path through which a second fluid flows are formed inside of the plate package, and wherein either the first fluid or the second fluid flows inside of the socket.

10. The plate type heat exchanger of claim 9, wherein the socket includes at least one of:

a first inlet through which the first fluid flows into the plate package;

a first outlet through which the first fluid is discharged from the plate package;

a second inlet through which the second fluid flows into the plate package; and a second outlet through which the second fluid is discharged from the plate package.

11. A plate type heat exchanger, comprising:

a plate package in which a plurality of heat exchange plates is stacked to form a flow path, through which fluid flows;

an end plate coupled to an outside of the plate package; and a socket connected to the plate package by passing through the end plate, wherein the end plate includes:

a base which is in contact with the outside of the plate package;

a socket hole which is formed through the base and into which the socket is inserted; and a ridge that protrudes outward from an edge of the socket hole of the base, wherein the socket includes:

a socket body formed in a pipe shape;

a socket flange that extends from an end portion of the socket body in a radial direction of the socket body to have a diameter larger than a diameter of the socket body and is in contact with the ridge; and a sealing portion that extends from an end portion of the socket flange in an axial direction of the socket body to have a diameter smaller than the diameter of the socket body and is inserted into the socket hole, wherein the base includes a depression space between the ridge and the plate package, wherein the sealing portion is bent outward in the radial direction and extends into the depression space, and wherein a lower surface of the socket flange contacts an upper surface of the ridge and an upper surface of the sealing portion contacts a lower surface of the ridge.

12. The plate type heat exchanger of claim 11, wherein a depression depth of the depression space is the same as a thickness of the sealing portion.

13. The plate type heat exchanger of claim 11, wherein a heat exchange plate of the plurality of heat exchange plates disposed at an outermost side of the plurality of heat exchange plates and the sealing portion are in contact with each other.

14. The plate type heat exchanger of claim 11, wherein the plurality of heat exchange plates includes:

a first plate formed at a position corresponding to the socket and having a first port communicating with the socket hole; and a second plate formed at a position corresponding to the socket and having a second port communicating with the first port.

15. The plate type heat exchanger of claim 11, wherein a first flow path through which a first fluid flows and a second flow path through which a second fluid flows are formed inside of the plate package, and wherein either the first fluid or the second fluid flows inside of the socket.

16. A plate type heat exchanger, comprising:

a plate package in which a plurality of heat exchange plates is stacked to form a flow path, through which fluid flows;

an end plate coupled to an outside of the plate package; and a socket connected to the plate package by passing through the end plate, wherein the end plate includes:

a base which is in contact with the outside of the plate package;

a socket hole which is formed through the base and into which the socket is inserted; and a ridge that protrudes outward from an edge of the socket hole of the base, wherein the socket includes:

a socket body formed in a pipe shape;

a socket flange that extends from an end portion of the socket body in a radial direction of the socket body to have a diameter larger than a diameter of the socket body and is in contact with the ridge; and a sealing portion that extends from an end portion of the socket flange in an axial direction of the socket body to have a diameter smaller than the diameter of the socket body and is inserted into the socket hole, wherein the base includes a depression space between the ridge and the plate package, wherein an end of the sealing portion is bent outward in the radial direction and extends into the depression space, and wherein the ridge is disposed between the socket flange and the end of the sealing portion.

17. The plate type heat exchanger of claim 16, wherein a depression depth of the depression space is the same as a thickness of the sealing portion.

18. The plate type heat exchanger of claim 16, wherein a heat exchange plate of the plurality of heat exchange plates disposed at an outermost side of the plurality of heat exchange plates and the sealing portion are in contact with each other.

19. The plate type heat exchanger of claim 16, wherein the plurality of heat exchange plates includes:

a first plate formed at a position corresponding to the socket and having a first port communicating with the socket hole; and a second plate formed at a position corresponding to the socket and having a second port communicating with the first port.

20. The plate type heat exchanger of claim 16, wherein a first flow path through which a first fluid flows and a second flow path through which a second fluid flows are formed inside of the plate package, and wherein either the first fluid or the second fluid flows inside of the socket.

* * * * *